US007107635B2

(12) United States Patent
Henry et al.

(10) Patent No.: US 7,107,635 B2
(45) Date of Patent: Sep. 19, 2006

(54) FITTED SHEET WITH BOLSTERS MOUNTED THEREON

(76) Inventors: Jodi M. Henry, 89910 New Rumley Rd., Jewett, OH (US) 43986; Judith O. Mugnaini, 89900 New Rumley Rd., Jewett, OH (US) 43986

( * ) Notice: Subject to any disclaimer, the term of this patent is extended or adjusted under 35 U.S.C. 154(b) by 115 days.

(21) Appl. No.: 10/997,342

(22) Filed: Nov. 24, 2004

(65) Prior Publication Data

US 2005/0138730 A1 Jun. 30, 2005

Related U.S. Application Data

(60) Provisional application No. 60/608,790, filed on Sep. 10, 2004, provisional application No. 60/524,424, filed on Nov. 24, 2003.

(51) Int. Cl.
*A47G 9/02* (2006.01)
*A47C 21/08* (2006.01)

(52) U.S. Cl. ..... 5/424; 5/425; 5/732; 5/482

(58) Field of Classification Search ..... 5/724, 5/725, 732, 482, 923, 424, 425, 497
See application file for complete search history.

(56) References Cited

U.S. PATENT DOCUMENTS

| | | | | |
|---|---|---|---|---|
| 2,586,031 | A | | 2/1952 | Hahne |
| 3,148,388 | A | | 9/1964 | Espersen |
| 3,638,251 | A | | 2/1972 | Weiss |
| 4,872,228 | A | | 10/1989 | Bishop |
| 4,873,734 | A | | 10/1989 | Pollard |
| 4,890,346 | A | * | 1/1990 | Rist ..... 5/658 |
| 4,964,184 | A | | 10/1990 | Lewis |
| 4,967,434 | A | | 11/1990 | Hill |
| 5,014,399 | A | | 5/1991 | Grisel |
| 5,103,514 | A | | 4/1992 | Leach |
| 5,165,128 | A | | 11/1992 | Honig |
| 5,263,212 | A | | 11/1993 | Garcia |
| 5,327,595 | A | | 7/1994 | Allen |
| 5,351,348 | A | * | 10/1994 | Beger ..... 5/420 |
| 5,359,739 | A | * | 11/1994 | Rains et al. ..... 5/81.1 R |
| 5,438,719 | A | | 8/1995 | Anthony |
| 5,442,822 | A | | 8/1995 | Diaz |
| 5,455,973 | A | * | 10/1995 | Brumfield et al. ..... 5/424 |
| 5,473,785 | A | * | 12/1995 | Lager et al. ..... 5/655 |
| 5,749,112 | A | | 5/1998 | Metzler |
| 5,996,147 | A | | 12/1999 | Trimble |
| 6,044,503 | A | | 4/2000 | McClendon |
| 6,049,925 | A | | 4/2000 | Lewis |

(Continued)

*Primary Examiner*—Alexander Grosz
(74) *Attorney, Agent, or Firm*—Sand & Sebolt

(57) ABSTRACT

A fitted bed sheet has a pair of roll guards mounted thereon to prevent a toddler or other person from rolling out of bed. Each roll guard is removably disposed in a slip cover mounted on the sheet by a flexible strip of material, which allows each roll guard to move between a first position atop the sheet and a second position beside the sheet with the roll guard hanging from the flexible strip. Each roll guard is securable in the raised position by the linking of fastener strips having hook and loop fasteners mounted on the slip cover and fabric loops mounted on the sheet. Each roll guard is removably mounted to the sheet via a zipper between the sheet and the flexible strip of material mounted on the slip cover. A plurality of elastic straps is mounted axially on the bottom of the sheet to help secure the sheet on a mattress.

20 Claims, 10 Drawing Sheets

U.S. PATENT DOCUMENTS

| | | | | |
|---|---|---|---|---|
| D436,488 | S | 1/2001 | Johnson | |
| 6,481,030 | B1 | 11/2002 | Bravo et al. | |
| 6,539,565 | B1 | 4/2003 | Trimble | |
| 6,651,278 | B1 | 11/2003 | Ghanem | |
| 6,658,676 | B1 | 12/2003 | Persson et al. | |
| 6,668,399 | B1 | 12/2003 | Malstaff et al. | |
| 6,708,356 | B1 | 3/2004 | LaValle | |
| 2004/0064889 | A1 * | 4/2004 | Diak-Ghanem | 5/482 |

* cited by examiner

FITTED SHEET WITH BOLSTERS MOUNTED THEREON

CROSS REFERENCE TO RELATED APPLICATIONS

This application claims priority from U.S. Provisional Application Ser. No. 60/524,424, filed Nov. 24, 2003 and U.S. Provisional Application Ser. No. 60/608,790, filed Sep. 10, 2004.

BACKGROUND OF THE INVENTION

1. Technical Field

The invention relates generally to fitted bed sheets. More particularly, the invention relates to a fitted bed sheet with roll guards mounted thereon to guard against toddlers or other persons rolling out of bed. Specifically, the invention relates to such a sheet wherein the roll guards are movable to a lowered position to facilitate a person getting in and out of bed and removable from the bed sheet to facilitate washing and leave a substantially standard fitted bed sheet for use without the roll guards.

2. Background Information

There are many types of fitted bed sheets, including some configured with other things mounted thereon, such as pillows and roll guards. Some roll guard systems are used in conjunction with hospital beds and mount to the bed railings or use the railings for support. Similarly, some are used in conjunction with crib mattresses and are supported by the sides thereof.

However, there remains in the field a need for a fitted sheet and roll guard system which addresses the problems related to a toddler's transition from a crib to a bed which uses standard sheets. When a toddler become too large for his or her crib, continuing to use the once-protecting crib actually may become a safety hazard as the toddler attempts climbing out of the crib. At this point, parents are faced with how to transition the toddler to another bed. One option is to use a toddler bed, which traditionally uses a crib mattress. However, toddler beds are fairly costly and take up space which may not be available in the toddler's home merely to accommodate this relatively short period of sleeping in a transition bed. In addition, many of the toddler beds are actually hazardous, as evidenced by the numerous recalls issued in regard thereto.

Another option is a convertible crib, which may be used initially as a crib in the standard sense and subsequently as a toddler bed via removal of a guard rail on one side, which permits the toddler to climb in and out of the converted crib. However, the sleeping surface of the convertible crib, now unprotected on one side, is still high enough above the ground to be a safety hazard during sleep.

Thus, while roll guards used in conjunction with sheets and beds is generally known, there remains a need for a fitted sheet that provides for the toddler's transition from a crib to a bed which uses standard sheets. Thus, there is a need for such a fitted sheet which uses roll guards to prevent the child from rolling out of bed, which allows the bed to be safely used during play time without the roll guard interfering with the child getting on and off the bed, and finally to be used as a standard fitted sheet when the child has graduated from a need for the roll guards.

Thus, the multi-faceted transition problem recognized herein is resolved by the present invention, which provides a unique, simple and multiple-use system which is cost effective and convenient.

BRIEF SUMMARY OF THE INVENTION

The present invention provides an apparatus comprising a fitted bed sheet; and at least one roll guard mounted on the sheet and movable between a first position atop the sheet and a second position beside the sheet.

The present invention further provides an apparatus comprising a fitted bed sheet; a flexible strip of material; and at least one roll guard mounted on the sheet via the flexible strip of material and movable between a first position atop the sheet and a second position beside the sheet; wherein the at least one roll guard is selectively securable to the sheet in the first position and hangs from the flexible strip in the second position.

The present invention also provides an apparatus comprising a fitted bed sheet having a top panel; at least one roll guard mounted on the sheet and movable between a first position atop the top panel of the sheet and a second position beside the sheet; wherein the at least one roll guard is selectively securable to the sheet in the first position via a plurality of securing structures which are made of fabric and mounted on the top panel of the sheet.

BRIEF DESCRIPTION OF THE SEVERAL VIEWS OF THE DRAWINGS

Similar numerals refer to similar parts throughout the specification.

DETAILED DESCRIPTION OF THE INVENTION

Figure 1:
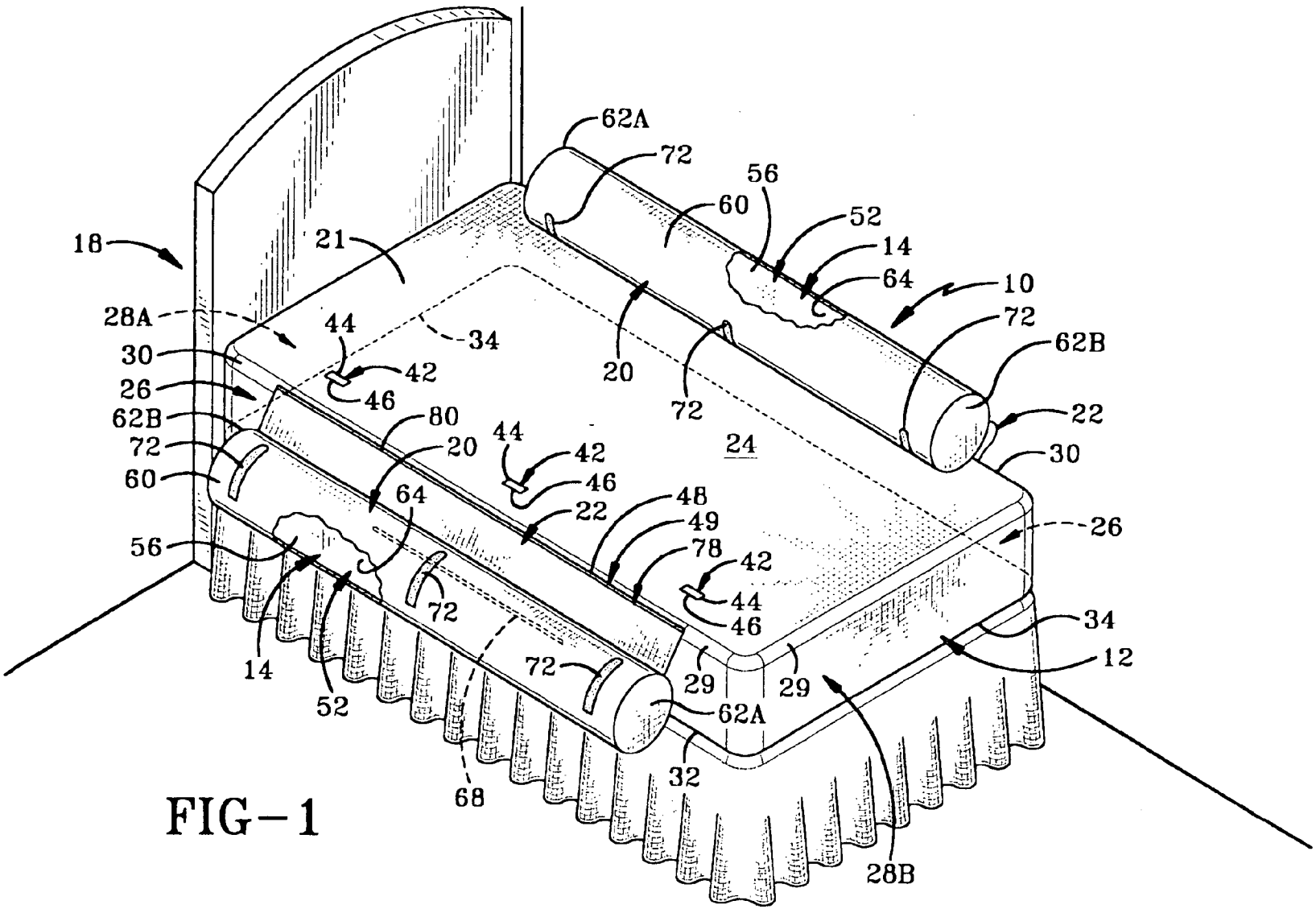
FIG. 1 is a perspective view of a first embodiment of the bolster bed sheet of the present invention with one roll guard in a raised position adjacent the wall of a room and one roll guard in a lowered position.
Figure 11:
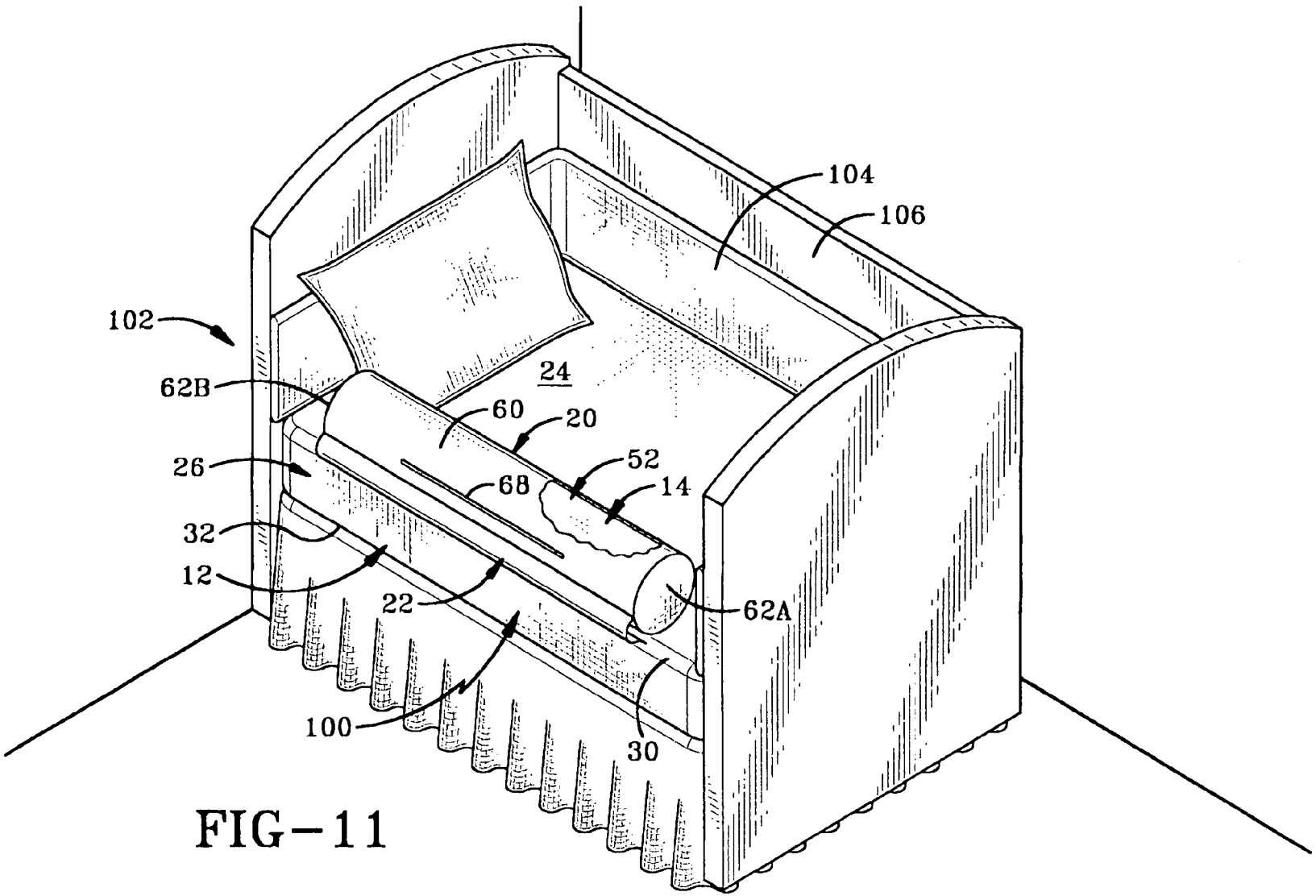
FIG. 11 is a perspective view of a second embodiment of the present invention showing the bolster bed sheet of the present invention with a single roll guard in the raised position in use with a convertible crib.

A first embodiment of the bolster bed sheet of the present invention is indicated generally at 10 in FIG. 1 and a second embodiment is indicated generally at 100 in FIG. 11. Bolster sheet 10 includes a fitted sheet 12 and a pair of roll guards in the form of bolsters 14 mounted thereon. Bolster sheet 10 fits on a mattress 16 (FIGS. 2 and 4) so that bolsters 14 guard against a toddler or other person rolling off a bed 18. Preferably, each bolster 14 is removably contained in a bolster slip cover 20 which is connected to a flexible material strip 22 removably mounted on fitted sheet 12. Preferably, each bolster 14 is removably mounted on sheet 12 and is movable between a raised position atop sheet 12 and a lowered position beside sheet 12 while mounted on sheet 12. FIG. 1 shows one bolster 14 in the raised position (upper right) adjacent a wall of a room and one bolster 14 in the lowered position (lower left).

Fitted sheet 12 is most preferably a high-thread-count fitted sheet to facilitate durability and ability to mount bolsters 14 and other attachments thereto without tearing sheet 12. Sheet 12 is typically formed of a single piece of fabric which extends around the mattress as is commonly known in the art with at least some of the edges being elasticized to help secure sheet 12 to mattress 14. Sheet 12 may, however, be formed of a plurality of pieces of fabric sewn together. For the purposes of this application, the various portions of sheet 12 will be described in a manner which may indicate either a single piece of fabric or a plurality of pieces joined to one another. Thus, the term "panel" as a descriptor with regard to sheet 12 may refer to a portion of sheet 12 which is a separate piece of fabric, a portion of a single-piece sheet, or any combination of pieces. In addition, because sheet 12 typically takes on a relatively crumpled form when not installed on mattress 14, the various portions of sheet 12 are described as configured when mounted on mattress 14 in order to facilitate an understanding of the invention. This manner of description is not intended to limit the scope of the invention in any regard, but is merely for purposes of overall clarity and to provide meaningful reference points for structure that would otherwise be relatively amorphous.

Sheet 12 has an outer surface 21, an inner surface 23 (FIG. 4), and includes a top panel 24, a pair of opposed side panels 26 extending downwardly therefrom along opposed sides of top panel 24 and a pair of opposed end panels 28 extending downwardly from top panel 24 along opposed ends thereof. Each side panel 26 is elongated longitudinally and each end panel is elongated axially. End panels 28 extend between and are connected to end panels 28. End panels 28 include a head end panel 28A and a foot end panel 28B. More particularly, top panel 24 has an outer perimeter 29 from which each side panel 26 and end panel 28 extend downwardly. Each side panel 26 at an upper edge thereof meets top panel 24 at a respective intersection 30, which lies on a portion of perimeter 29 of top panel 24. Each side panel 26 has a lower edge 32 and each end panel 28 has a lower edge 34.

Figure 2:
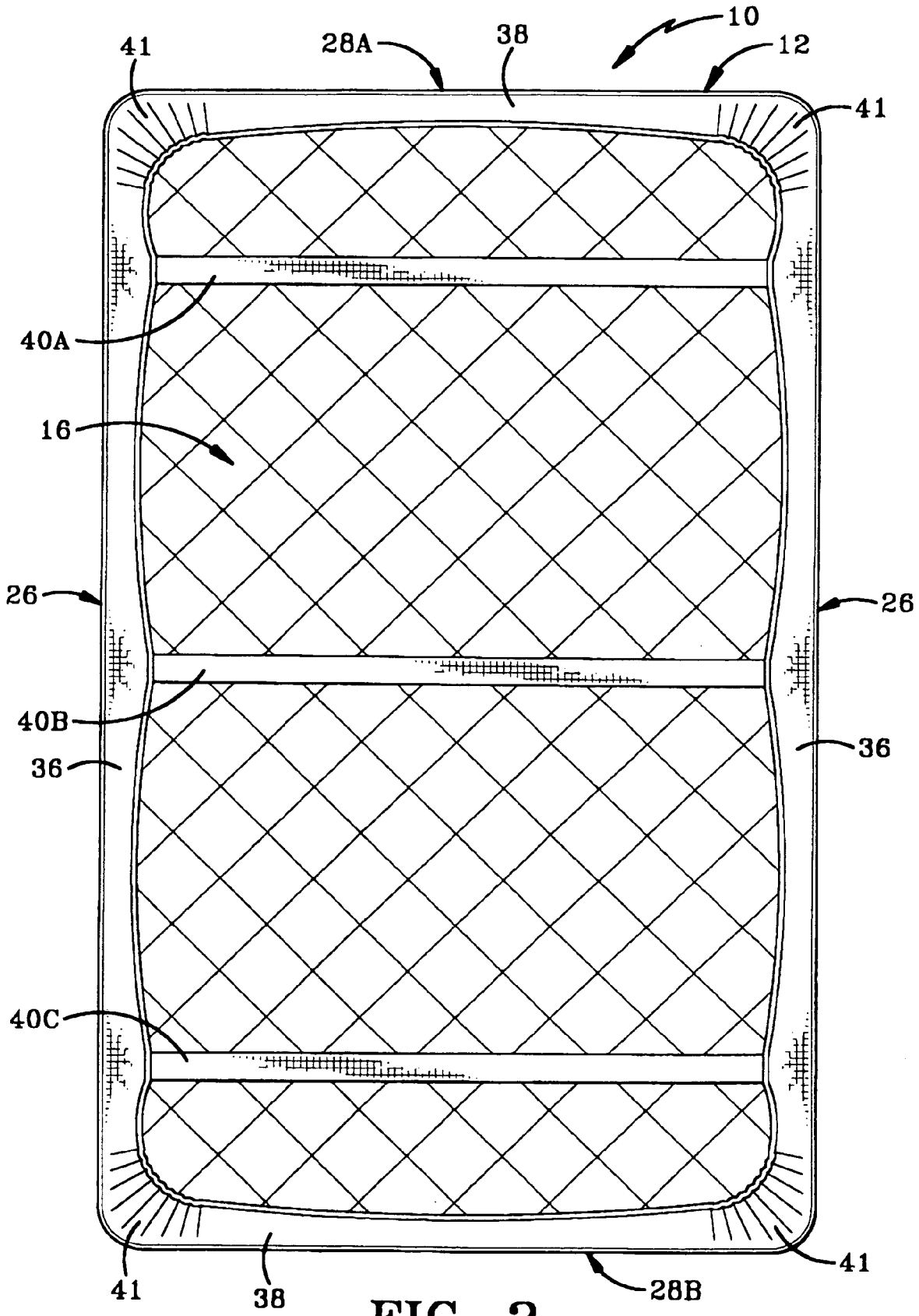
FIG. 2 is a bottom plan view of the first embodiment showing three elastic straps across the bottom of the mattress.

With reference to FIG. 2, each side panel 26 includes an inwardly extending projection 36 and each end panel includes an inwardly extending projection 38. Each of projections 36 and 38 extend inwardly only a relatively short distance and serve to help secure sheet 12 in position on mattress 16. In accordance with a feature of the invention, three relatively narrow and elongated elastic straps 40A-C extend between and are connected to each of projections 36 of side panels 26. Elastic straps 40 are longitudinally spaced from one another and are substantially parallel to end panels 28 and substantially perpendicular to side panels 26. Strap 40B is centrally located, strap 40A is located adjacent head end portion 28A and strap 40C located adjacent foot end portion 28B. As well known in the art, projections 38 of end panels 28 are elasticized, as is at least a portion of projections 36 of side panels 26 so that the four corners are elasticized as indicated at 41. The elasticized sheet 12, in particular around the corners works in conjunction with elastic straps 40 to secure sheet 12 to mattress 16 with mattress 16 within a mattress-receiving space defined by top panel 24, side panels 26, end panels 28 and straps 40. Each projection 36 may be elasticized along its entire length if desired.

In accordance with another feature of the invention and with reference to FIG. 1, a plurality of fabric loops 42 is mounted on top panel 24 of sheet 12, each loop 42 or a combination of loops 42 being a roll guard-securing or bolster-securing structure for securing a respective bolster 14 in the raised position. More particularly, two sets of three loops 42 are each sewn to top panel 24 in a reinforced fashion whereby each set of loops 42 is disposed adjacent a respective side panel 26. The three loops 42 of each set are longitudinally spaced from one another and substantially equidistantly spaced inwardly from a respective side panel 26 whereby the loops 42 of each set are aligned with one another along the length of sheet 12. Each loop 42 includes a strip 44 of fabric which is longitudinally elongated whereby each strip 44 and top panel 24 adjacent the respective strip 44 form there between an axially extending passage 46. Each strip 44 is disposed on outer surface 21 of sheet 12 and sewn to a reinforcement 47 (FIG. 4) disposed on inner surface 23 of sheet 12 opposite strip 44.

Figure 3:
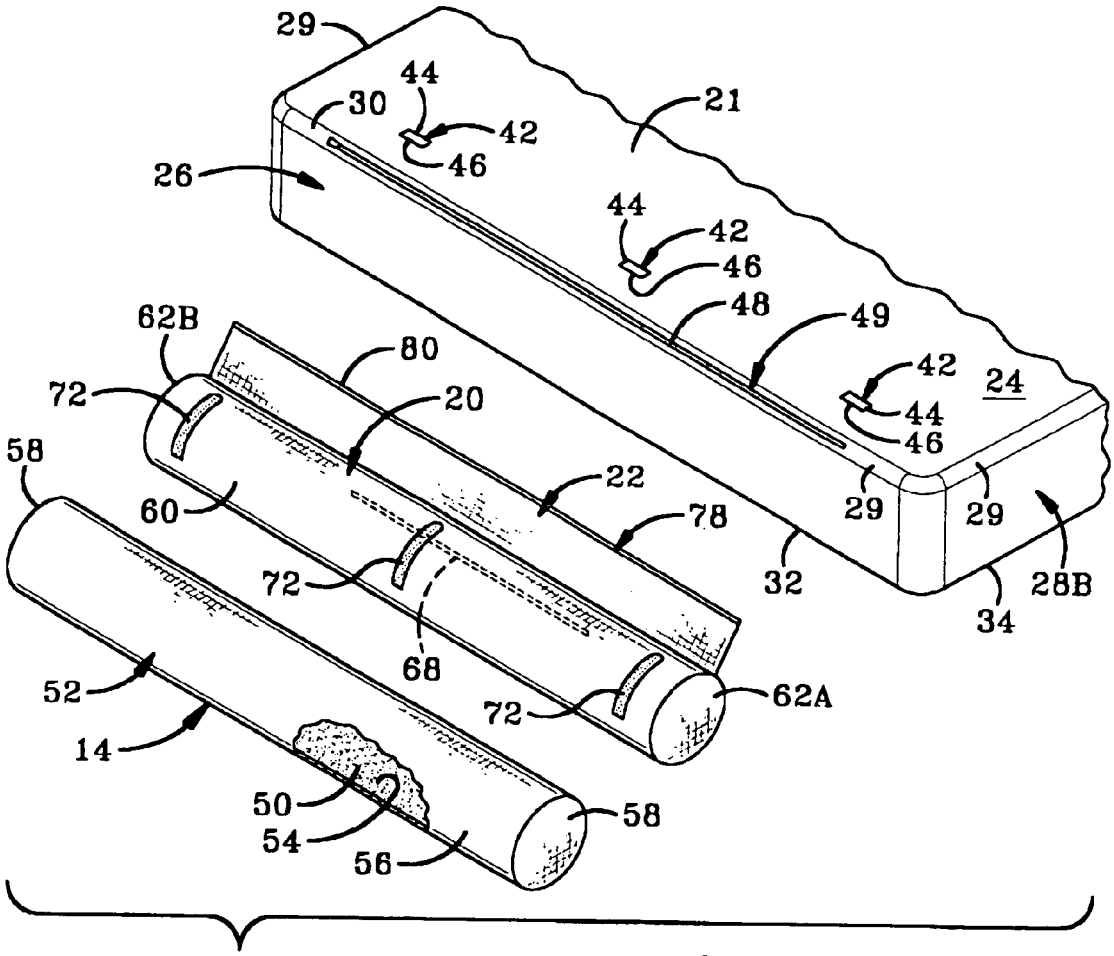
FIG. 3 a fragmentary exploded perspective view of the first embodiment.
Figure 5:
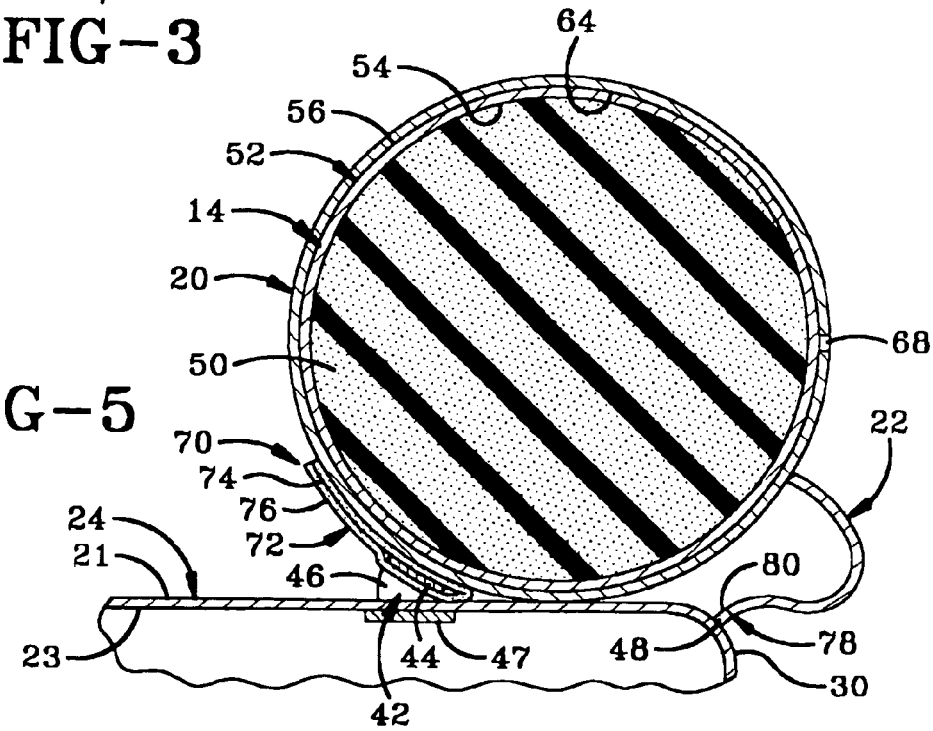
FIG. 5 is an enlarged sectional view showing the connection between the loops on the bed sheet and the hook and loop fastener on the slip cover.

In accordance with another feature of the invention, each respective bolster 14, slip cover 20 and flexible strip 22 are removably mounted on sheet 12 via a roll guard-mounting or bolster-mounting mechanism in the form of detaching zipper 49 (FIG. 1). With reference to FIG. 3, a half zipper 48 is mounted on sheet 12 via a sewn connection along each intersection 30 of top panel 24 and each respective side panel 26. Thus, half zipper 48 is sewn directly to sheet 12 via at least one of top panel 24 and side panel 26 so that when bolsters 14 are removed via respective zippers 49, fitted sheet 12 may be used as a standard fitted sheet without bolsters 14. Half zipper 48 extends along intersection 30 over a substantial portion of the length of sheet 12. The length of half zipper 48 may vary in accordance with the length of bolsters 14, slip cover 20 and strip 22. Half zipper 48 is positioned closer to head end panel 28A than to foot end panel 28B, although this may vary depending on the desired positioning of bolsters 14. In addition, half zipper 48 may be in other positions axially spaced from intersection 30, that is on top panel 24 or side panel 26. Preferably, however, half zipper 48 is positioned adjacent intersection 30 so that flexible strip 22 permits movement of slip cover 20 and bolster 14 between the raised and lowered positions while minimizing the amount of material of which strip 22 is formed.

Figure 4:
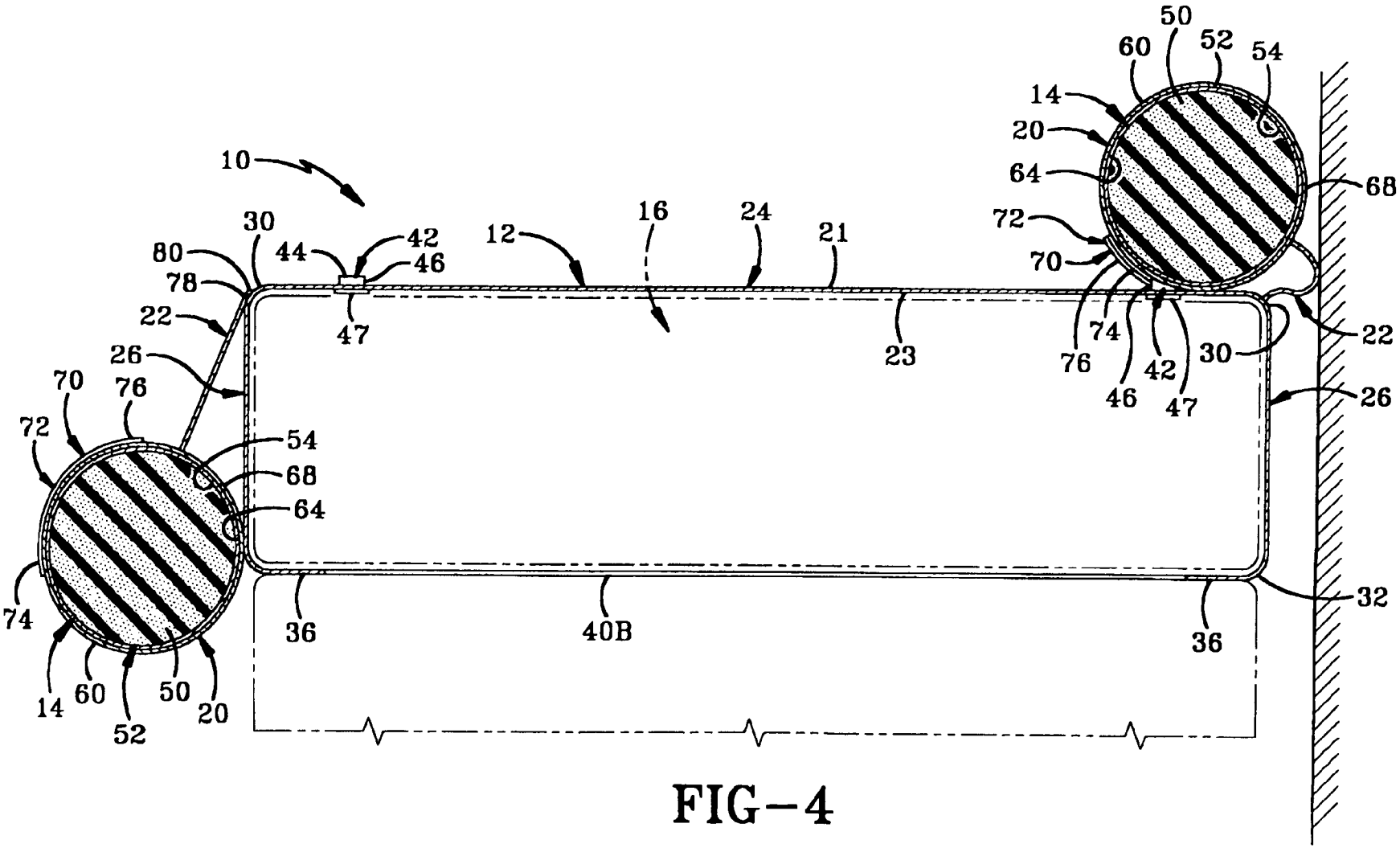
FIG. 4 is a sectional view of FIG. 1 across the width of the bed and bolster bed sheet.

With reference to FIG. 4, each bolster 14 includes a core 50 and a bolster cover 52 defining an interior chamber 54 in which core 50 is encased. Core 50 has a substantially circular cross section and thus is substantially cylindrical. However, other shapes may be used as well, such as square, rectangular, triangular or elliptical cross sections. Core 50 is preferably made of foam, preferably a fairly high density foam suited to the purpose. Other suitable materials may be used which are known from the stuffing of pillows and so forth. A reasonably high density foam is preferred because it provides sufficient support for use as a roll guard, is durable, washable, light weight for handling and shipping, and may be compressed for shipping and expand to its desired shape for use as described herein.

With reference to FIGS. 3 and 4, bolster cover 52 includes a substantially cylindrical elongated sidewall 56 and a pair of opposed end walls 58 (FIG. 3) which cap respective ends of sidewall 56 to form interior chamber 54 (FIGS. 1 and 4) there within. As discussed with regard to core 50, the shape of end walls 58 may be altered as desired to match the shape of bolster 14. Bolster cover 52 is preferably made of a durable cloth, muslin being a very desirable choice. The use of such a cloth prevents the picking of foam, especially by toddlers, which would otherwise be destructive to core 50 and may also present a choking hazard for toddlers. In addition, such a cloth is washable along with core 50 and helps keep core 50 intact during washing and general use. Further, cover 52 facilitates installation and removal of bolster 14 from slip cover 20 by substantially reducing the frictional engagement of core 50 with slip cover 20 especially when core 50 is made of foam.

With reference to FIGS. 1 and 4, slip cover 20 includes a substantially cylindrical elongated sidewall 60 and a pair of opposed end walls 62A and 62B which cap respective ends of sidewall 60 to form there within an interior chamber 64 in which bolster 14 is removably disposed. Each slip cover 20 is interchangeable with the other due to the fact that the respective detaching zippers 49 are mounted in reverse with respective to one another, thereby allowing either slip cover 20 to be mounted adjacent either of side panels 26. Thus, end wall 62A of one slip cover 20 is adjacent head end panel 28A and the end panel 62A of the other slip cover 20 is adjacent foot end panel 28B, with respective end walls 62B in corresponding reversed positions.

Figure 6:
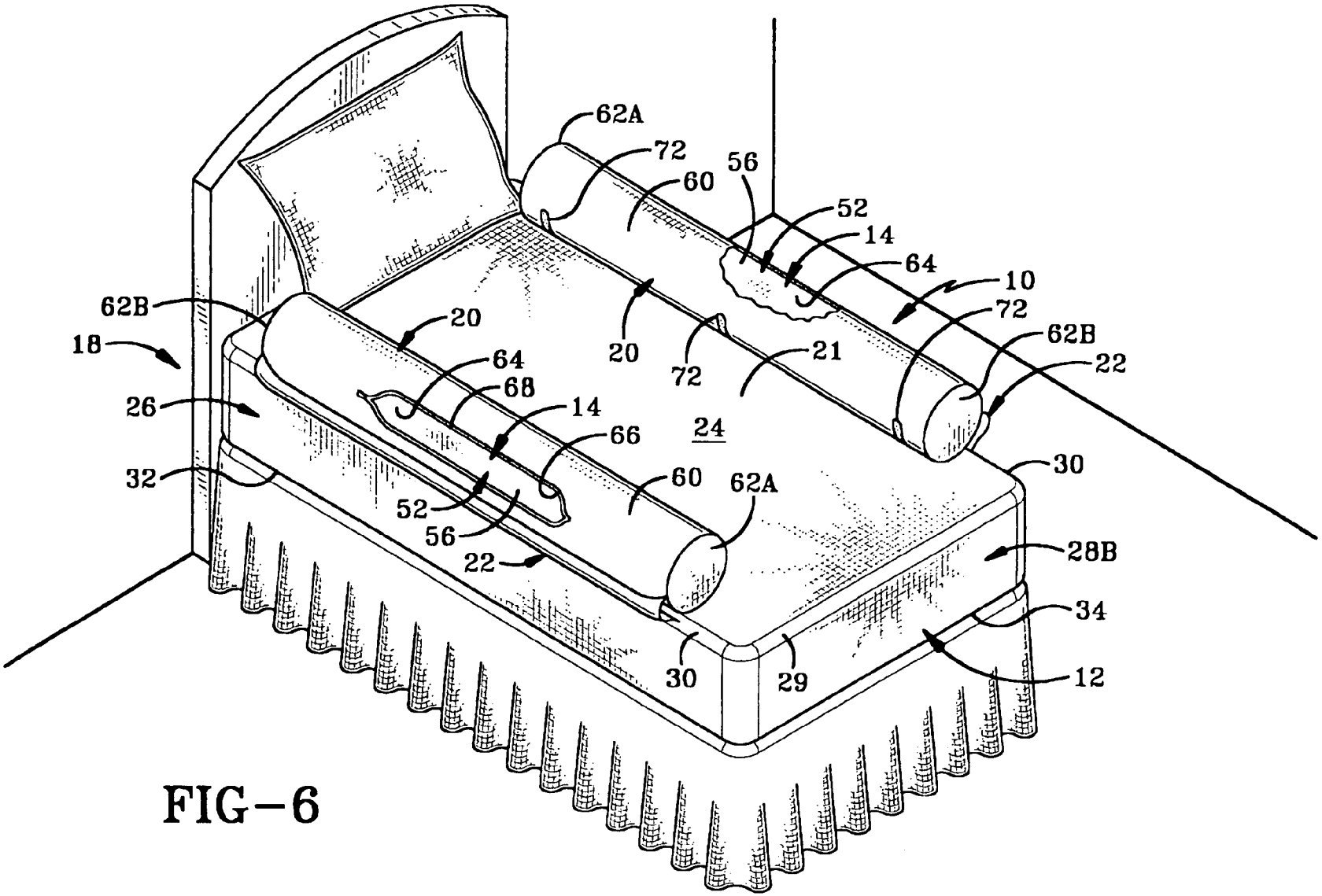
FIG. 6 is similar to FIG. 1 with both roll guards in respective raised positions and showing the opening zipper on one slip cover in an unzipped position with the roll guard inside.
Figure 7:
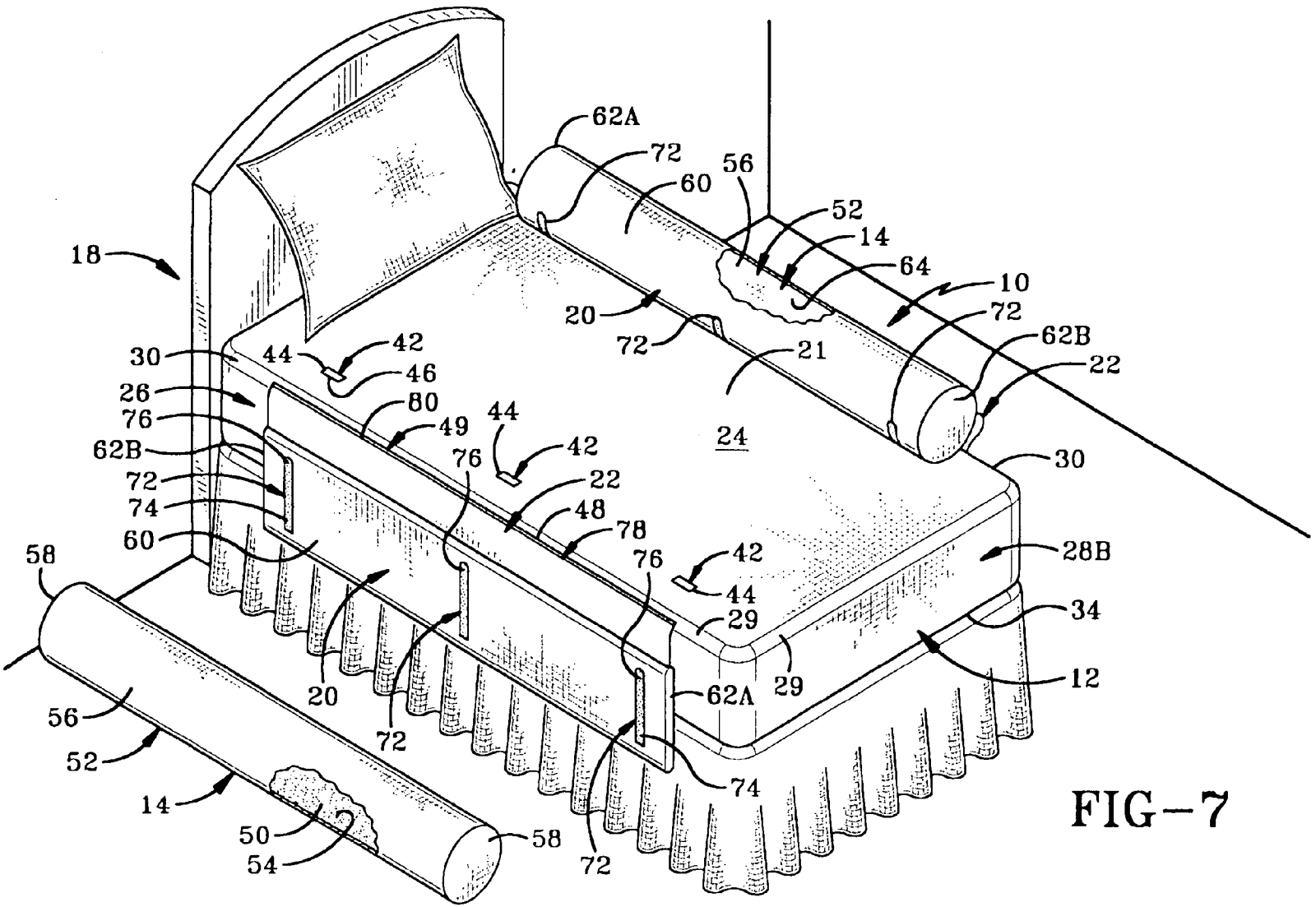
FIG. 7 is similar to FIG. 6 and show the slip cover generally flattened with the roll guard removed therefrom.

The shapes of slip cover 20 and particularly end walls 62 may vary as discussed above and, of course, the overall shape of cover 20 substantially flattens when bolster 14 is removed. In accordance with a feature of the invention, slip cover 20 is selectively openable for insertion of bolster 14 into or removal of bolster 14 from interior chamber 64. More particularly, sidewall 60 defines an opening 66 (FIG. 6) which may be opened or closed as desired for respectively permitting said insertion and removal, and also for the securement of bolster 14 within chamber 64. An opening zipper 68 is mounted on sidewall 60 to provide the selective opening and closing of slip cover 20. FIG. 6 shows zipper 68 in an open position with bolster 14 disposed within interior chamber 64. FIG. 7 shows bolster 14 after removal from chamber 64 via opening 66 (FIG. 6) and slip cover 20 in a generally flattened configuration hanging from flexible strip 22 beside sheet 12.

With reference to FIGS. 1 and 3–5, at three locations on sidewall 60 of slip cover 20, a bolster-securing structure is mounted on sidewall 60 of slip cover 20 in the form of a hook and loop fastener 70. In particular, each fastener 70 includes a longitudinally elongated strip 72 of material having a hook portion 74 and loop portion 76 adjacent thereto and foldable onto hook portion 74 to form a loop and provide a securing engagement between portions 74 and 76. When bolsters 14 and slip covers 20 are in the raised position, each strip 72 is selectively insertable through one of passages 46 of a respective loop 42 and folds on itself as noted above to secure strip 74 in a loop-to-loop or link-to-link configuration with loop 42, thereby securing bolster 14 and slip cover 20 in the raised position atop top panel 24 of sheet 12. Strip 72 also provides an advantage in the lowered position, as the rough surface of hook portion 74 is covered by loop portion 76, thereby helping prevent scratching injuries to playing children or others.

Figure 8:
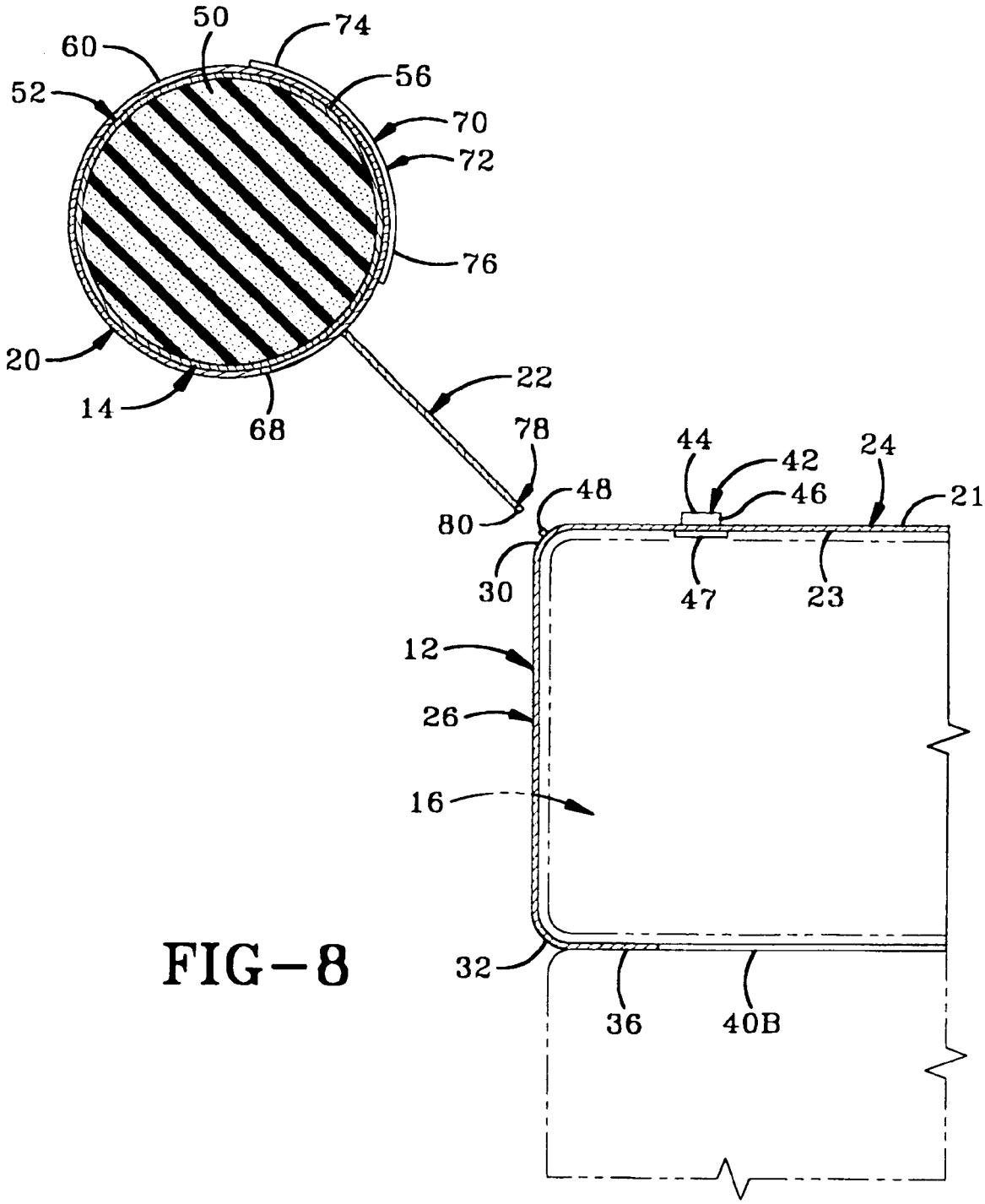
FIG. 8 is an enlarged fragmentary sectional view showing the detaching zipper unzipped with the slip cover and roll guard removed from the fitted sheet.

In accordance with a feature of the invention, flexible material strip 22 is connected to and extends outwardly from sidewall 60 of slip cover 20. Strip 22 may be a separate piece from sidewall 60 or the two may be formed integrally in one piece. Strip 22 has a terminal edge 78 distal its connection to slip cover 20 along which a half zipper 80 is mounted. Half zipper 80 is selectively securable to half zipper 48 to mount strip 22 to sheet 12, thereby mounting slip cover 20 and bolster 14 when disposed in cover 20 on sheet 12. Half zippers 48 and 80 together form detaching zipper 49 (FIG. 1). Strip 22, when secured to sheet 12, serves as a flexible connector between sheet 12 and slip cover 20 and, as previously noted, allows bolster 14 and slip cover 20 to move between the raised and lowered positions. Bolster 14 and slip cover 20 hang from strip 22 in the lowered position. Unzipping half zipper 80 from half zipper 48 also allows strip 22 and slip cover 20, along with bolster 14, to be selectively removed from sheet 12 (FIGS. 3 and 8).

It is noted that each bolster 14 is removable from sheet 12 in two ways. First, bolsters 14 may be removed from slip cover 20 so that sheet 12, slip cover 20 and flexible strip 22 form a unit separate from bolster 14 (FIG. 7, showing one bolster 14 removed). As such, this unit may be washed separately from bolster 14 and/or may be used on mattress 16 as desired to provide bed 18 with a side free of the removed bolster 14. This may be desirable for use of bed 18 for sitting on the side thereof without the interference of bolster 14. Second, bolster 14, slip cover 20 and flexible strip 22 may be separated from sheet 12 by unzipping zipper 49, as shown in FIG. 8. This allows quick and easy removal of bolster 14 for use of bed 18 without interference of bolster 14. When both bolsters 14 are removed in this fashion, sheet 12 may be used simply as a typical fitted sheet when bolsters 14 are no longer needed or desired. This also allows for the separate washing of sheet 12 and when bolster 14 is removed from slip cover 20, the separate washing of slip cover 20 and flexible strip 22.

Figure 9:
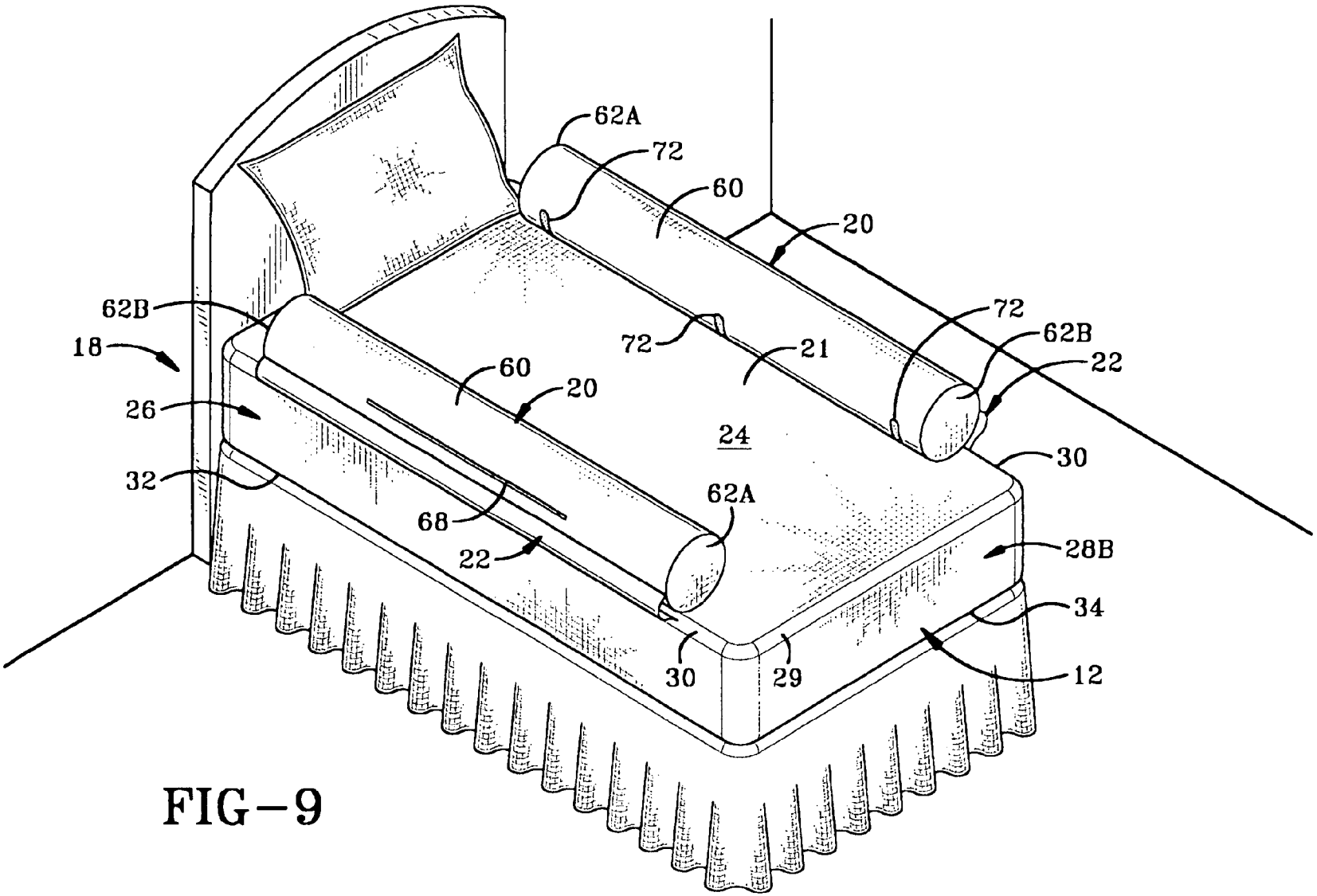
FIG. 9 is a similar to FIG. 1 with both roll guards in respective raised positions.
Figure 10:
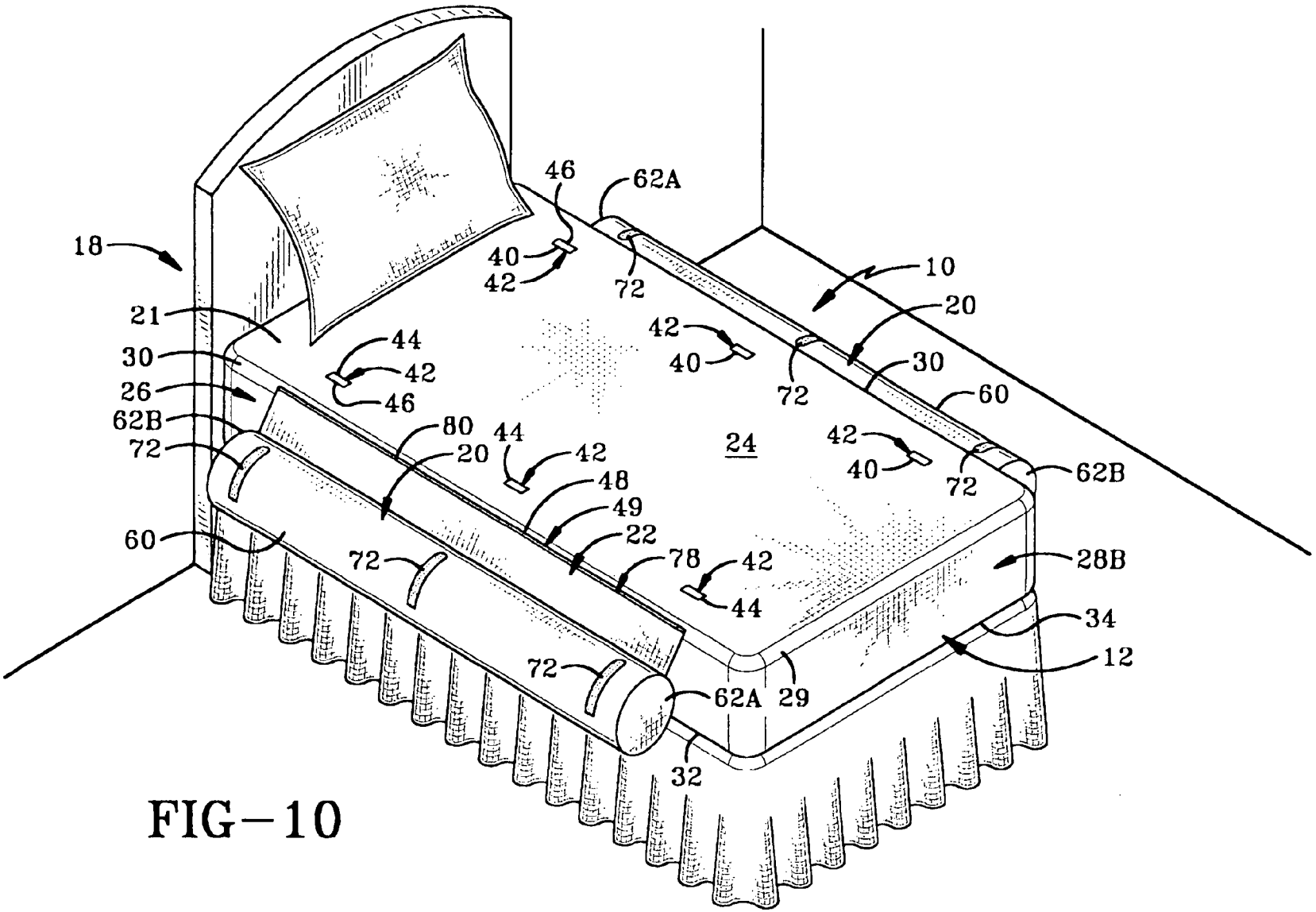
FIG. 10 is a similar to FIG. 9 with both roll guards in respective lowered positions.

FIG. 9 shows bolster bed sheet 10 with both bolsters 14, slip covers 20 and flexible strips 22 in the raised position and FIG. 10 shows bolster bed sheet 10 with the same in the lowered position.

FIG. 11 shows bolster bed sheet 100, which is similar to bolster bed sheet 10 except that it is smaller to fit a crib-sized mattress for use with a convertible crib 102 and includes only one bolster 14, slip cover 20, flexible strip 22 and the various other structure associated therewith. Convertible crib 102 is a crib which may be converted to a toddler's bed by the removal of sides normally used on a standard crib. This forms an open side which a toddler may climb in and out of. Toddlers typically use such convertible cribs during a transition to a larger bed. While a pair of bolsters 14 may be used with convertible crib 102, this is not necessary, as the bumper 104 commonly used with cribs provides padding and a sidewall 106 of the crib acts as the other guard in conjunction with bolster 14 of sheet 100.

The use of bolster bed sheet 100 provides a variety of options with regard to the transition using crib 102 first as a crib and subsequently as a toddler bed. First, a standard sheet may be used when crib 102 is used as a crib and then sheet 100 may be used in the transition stage to provide the safety of roll guard 14, thus eliminating the need for a separate toddler bed prior to the toddler graduating to a standard size bed. Bolster bed sheet 100 also allows fitted sheet 12 to be used by itself as a standard crib sheet prior to conversion of crib 102 and then with roll guard protection after conversion to a toddler bed. In addition, sheet 100 may then be used again for subsequent children using crib 102.

Thus, bolster bed sheets 10 and 100 provide a safe, stable and secure surrounding during sleep while also allowing for the use of a safe bed during play time by allowing the roll guard system to hang beside the bed. In the lowered position, the roll guards additionally provide a soft bumper which may prevent children from injury on hard bed frame structure. Where a bed is positioned with one side adjacent the wall of a room, the roll guard adjacent the wall in the raised position during sleep provides a comfortable barrier which prevents getting wedged between the bed and the wall and may also provide soft support for the head or back when laying or sitting across the bed. In addition, the roll guard system is quickly and easily removed from sheet 12 by a simple unzipping manipulation to allow for separate washing and/or replacement of the various structures and to allow use of fitted sheet 12 as a stand-alone item once a child has outgrown the need of roll guard protection. Thus, bolster bed sheets 10 and 100 provide a multi-use bedding system that grows with the child. While many of the attributes of the present invention are directed to the transition of a child from a crib bed to standard bed, it is also contemplated that the present invention is suitable for use by elderly or disabled persons who would benefit from the use of a roll guard, but would have difficulty getting in and out of bed with the roll guard positioned atop the bed.

It will be appreciated by one skilled in the art that a host of variations may be made to bolster bed sheets 10 and 110 which are within the scope of the invention. For instance, bolsters 14 may also be mounted in a variety of ways other than shown. For example, bolsters 14 may be attached directly to sheet 12 without slip cover 20 or flexible strip 22. In this configuration, bolsters 14 would not be movable between the raised and lowered positions. However, bolsters 14 would nonetheless provide a desirable guard against rolling off of a bed and may still be removable attached to sheet 12 to allow separation for washing and so forth and permit sheet 12 to be used as a standard fitted sheet when desired. Bolsters 14 may also be mounted on sheet 12 via a slip cover without the use of a flexible strip, thereby providing an extra layer of protection to bolster 14. In this configuration, the slip cover may also open to allow removal of bolster 14 and may be removably connected to sheet 12 to allow removal therefrom. In addition, a detaching zipper like zipper 49 may be disposed anywhere along flexible strip 22 and still allow for the slip cover and bolster to be removably mounted on the sheet. This may include positioning a detaching zipper where flexible strip 22 meets sidewall 60 of slip cover 20, so that slip cover 20 is removably mounted on flexible strip 22 and flexible strip 22 is directly attached to sheet 12.

It will be understood that while bolsters 14 are shown mounted adjacent opposed sides of sheet 12, similar bolsters may be mounted adjacent the ends of sheet 12. In addition, while most mattresses and bed sheets are rectangular, some may be square and less commonly have rounded edges and so forth. Bolsters may be mounted on fitted sheets having such alternate shapes as well. It is also understood that bolster bed sheet 10 may be sized for any suitable mattress. While the invention may be used primarily for toddlers, it is also applicable for use with, for example, elderly or disabled persons who need protection from rolling out of bed.

While elastic straps 40 extend from side to side in parallel fashion, it will be appreciated that similar straps may be, for example, in criss-cross relation, although this may make the fitted sheet more difficult to put on and take off of a mattress. In addition, elastic straps may extend from a side panel to an end panel or from and end panel to the opposite end panel. Each of these options will help secure the fitted sheet to the mattress. Elastic straps extending from side to side are preferred to those from end to end because the pressure against the bolsters tends to be in the side to side direction and thus side to side straps help secure the fitted sheet better. In addition, elastic straps 40 may be removably connected to at least one side to facilitate easier installation and removal of the fitted sheet from the mattress. A removable connection may be provided, for example, which is similar to that discussed above with hook and loop fasteners mounted on the elastic straps and a loop on or reinforced hole in the side panels through which the straps may extend and be fastened with the hook and loops folded onto one another.

Bolster securing mechanisms of various types may be used to secure bolsters in the raised position. One option involves a slip cover analogous to slip cover 20 mounted to sheet without a bolster-securing structure mounted on slip cover 20. For instance, a strap or belt may be separate from the slip cover and the sheet and may extend through a loop like loop 42 and around the slip cover in order to secure the slip cover and bolster therein in the raised position. In addition, bolster-securing structures other than loops 42 may be mounted on sheet 12 and structures other than hook and loop fasteners may be mounted on slip cover 20 to allow bolsters to be secured in the raised position. Such securing structures may include, for example, snaps, buttons, straps with buckles or portions thereof which are securable to related portions of such structures mounted on slip cover 20. Any other suitable structures known in the art may be used. It is most preferable that such structures provide a fitted sheet which does not have securing structures which may make the sheet uncomfortable when the bolsters are removed and the sheet is used separately. It is further most preferable with respect to the use of the bolster bed sheets for toddlers that such securing structures do not present choking hazards. Fabric loops 42 are highly desirable for both these reasons, as they are free of rigid members and made of a fabric similar to the material of which the sheet is formed, and thus relatively soft and comfortable to the touch, being free of rough, abrasive or scratchy surfaces such as are found, for example, on hook and loop fasteners.

Detaching zipper 49 may also be replaced with other removable bolster-mounting mechanisms. As noted with regard to alternate bolster-securing mechanisms above, any suitable fastener known in the art may be used. Zipper 49, however, is preferred as providing a very simple and cost-effective mounting mechanism which leaves a relatively smooth surface when sheet 12 is used by itself.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

What is claimed is:

1. An apparatus comprising:

a fitted bed sheet; and at least one roll guard mounted on the sheet and movable between a first position atop the sheet and a second position beside the sheet; and a first roll guard-securing structure mounted on the sheet for selectively securing the at least one roll guard in the first position.

2. The apparatus of claim 1 wherein the first roll guard-securing structure includes at least one flexible loop mounted on the sheet.

3. The apparatus of claim 2 wherein the at least one flexible loop defines a passage; and wherein a second roll guard-securing structure is mounted on the at least one roll guard and includes at least one flexible strip which passes through the passage to selectively secure the at least one roll guard in the first position.

4. The apparatus of claim 3 wherein the flexible strips each include a hook portion and a loop portion which fold together to selectively secure the at least one roll guard in the first position.

5. The apparatus of claim 1 wherein the sheet includes a top panel and a pair of opposed side panels extending from respective opposed sides of the top panel; wherein the side panels have respective lower edges; and wherein a plurality of elastic straps respectively extend between the lower edges and are mounted respectively to the side panels whereby the top panel, side panels and elastic straps define there between a mattress-receiving space.

6. The apparatus of claim 1 wherein the at least one roll guard includes a pair of roll guards mounted on the sheet adjacent respective sides thereof.

7. The apparatus of claim 1 wherein the bed sheet has a top panel;

wherein the first position is atop the top panel; and wherein the roll guard securing structure includes a plurality of securing structures which are made of fabric and mounted on the top panel of the sheet.

8. The apparatus of claim 7 wherein the securing structures are loops formed of fabric.

9. The apparatus of claim 7 wherein the securing structures are free of rigid members.

10. The apparatus of claim 1 wherein the fitted bed sheet comprises a top panel, a pair of opposed substantially parallel side panels and a pair of opposed end panels; the sheet having a longitudinal direction which is substantially parallel to the side panels;

wherein the at least one roll guard is movable between a raised position atop the top panel and a lowered position beside one of the side panels; and wherein no portion of the at least one roll guard extends outwardly beyond either end panel in the longitudinal direction of the sheet.

11. The apparatus of claim 10 in combination with a bed having a headboard and a mattress;

wherein the bed sheet is mountable on the mattress;

wherein when the bed sheet is mounted on the mattress one of the end panels is positioned closely adjacent or in abutment with the headboard when the mattress is in a first position; and wherein the at least one roll guard is movable between the raised and lowered positions while the mattress is in the first position.

12. The combination of claim 11 wherein the bed has a footboard; and wherein the other of the end panels is positioned closely adjacent or in abutment the footboard when the mattress is in the first position.

13. The combination of claim 10 where the apparatus is free of a roll guard mounted on either end panel of the bed sheet.

14. The apparatus of claim 1 wherein the at least one roll guard is removably mounted on the sheet via a detaching zipper.

15. The apparatus of claim 14 wherein the sheet has a top panel and a side panel extending therefrom; and wherein the detaching zipper includes a half zipper sewn directly to at least one of the top panel and the side panel whereby the sheet is useable as a standard fitted bed sheet when the at least one roll guard is removed from the sheet.

16. The apparatus of claim 1 wherein the at least one roll guard is mounted on the sheet via a flexible strip of material.

17. The apparatus of claim 16 wherein the at least one roll guard is disposed in a slip cover which is connected to the flexible strip.

18. The apparatus of claim 17 wherein the at least one roll guard is removably disposed in the slip cover.

19. The apparatus of claim 17 wherein the slip cover is removably mounted on the sheet.

20. An apparatus comprising:

a fitted bed sheet; and at least one roll guard mounted on the sheet and movable between a first position atop the sheet and a second position beside the sheet;

wherein the at least one roll guard includes a pair of roll guards mounted on the sheet adjacent respective sides thereof; and wherein each roll guard is removably mounted on the sheet via respective detaching zippers which are positioned in reverse orientation with respect to one another whereby the roll guards are interchangeable with one another.

* * * * *